US008062092B2

(12) United States Patent
Yang

(10) Patent No.: US 8,062,092 B2
(45) Date of Patent: Nov. 22, 2011

(54) SIMULATED EYE ASSEMBLY FOR TOY

(75) Inventor: Song-Ling Yang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 194 days.

(21) Appl. No.: 12/610,378

(22) Filed: Nov. 2, 2009

(65) Prior Publication Data

US 2010/0136879 A1 Jun. 3, 2010

(30) Foreign Application Priority Data

Dec. 2, 2008 (CN) ..... 2008 1 0305918

(51) Int. Cl.
*A63H 3/40* (2006.01)

(52) U.S. Cl. ..... 446/337; 446/342; 446/343; 446/392

(58) Field of Classification Search ..... 446/337–350; 74/412 R, 416, 417, 423
See application file for complete search history.

(56) References Cited

U.S. PATENT DOCUMENTS

| | | | | | |
|---|---|---|---|---|---|
| 2,660,830 | A | * | 12/1953 | Jentzen | 446/342 |
| 2,927,472 | A | * | 3/1960 | Grant | 74/378 |
| 3,353,296 | A | * | 11/1967 | Ryan et al. | 446/344 |
| 3,660,932 | A | * | 5/1972 | Raffeli et al. | 446/346 |
| 3,699,707 | A | * | 10/1972 | Sapkus | 446/131 |
| 3,959,919 | A | * | 6/1976 | Baulard-Cogan | 446/305 |
| 4,900,289 | A | * | 2/1990 | May et al. | 446/342 |
| 5,024,639 | A | * | 6/1991 | Crispo | 475/221 |
| 5,399,115 | A | * | 3/1995 | Arad et al. | 446/342 |
| 6,220,923 | B1 | * | 4/2001 | Lin | 446/392 |
| 7,837,531 | B2 | * | 11/2010 | Friedland et al. | 446/298 |
| 2006/0205320 | A1 | * | 9/2006 | Fekete et al. | 446/484 |
| 2007/0254554 | A1 | * | 11/2007 | Ellman et al. | 446/337 |
| 2008/0293325 | A1 | * | 11/2008 | Lei | 446/301 |
| 2009/0114059 | A1 | * | 5/2009 | Chu et al. | 74/661 |
| 2009/0305605 | A1 | * | 12/2009 | Lin et al. | 446/342 |

FOREIGN PATENT DOCUMENTS

| | | | | |
|---|---|---|---|---|
| JP | 06304338 | A | * | 11/1994 |
| WO | WO 2006082330 | A1 | * | 8/2006 |

* cited by examiner

*Primary Examiner* — Gene Kim
*Assistant Examiner* — Urszula M Cegielink
(74) *Attorney, Agent, or Firm* — Altis Law Group, Inc.

(57) ABSTRACT

A simulated eye assembly capable of being changeable from an opened state to a closed state and vice versa. The simulated eye assembly includes an eye portion, and a driving device assembly. The eye portion includes at least one eyelid, and at least one eyeball. The at least one eyelid is coverable on the at least one eyeball. The at least one eyelid is coupled to and driven to rotate with the driving device assembly. When the at least one eyelid is driven by the driving device assembly to rotate relative to the at least one eyeball to the closed state, the at least one eyeball is substantially hidden by the at least one eyelid. When the at least one eyelid is driven by the driving device to rotate relative to the at least one eyeball to the opened state, the at least one eyeball is exposed and viewable.

12 Claims, 4 Drawing Sheets

SIMULATED EYE ASSEMBLY FOR TOY

BACKGROUND

1. Technical Field

The disclosure relates to toys and, more particularly, to a simulated eye assembly for a toy.

2. Description of Related Art

Typical replica eyes of robot toys simulate by imitating various shapes of the human eyes. Accordingly, other effects are needed to make the eyes more lifelike.

BRIEF DESCRIPTION OF THE DRAWINGS

The components of the drawings are not necessarily drawn to scale, the emphasis instead being placed upon clearly illustrating the principles of the embodiments of the simulated eye assembly. Moreover, in the drawings, like reference numerals designate corresponding parts throughout several views.

DETAILED DESCRIPTION

Figure 1:
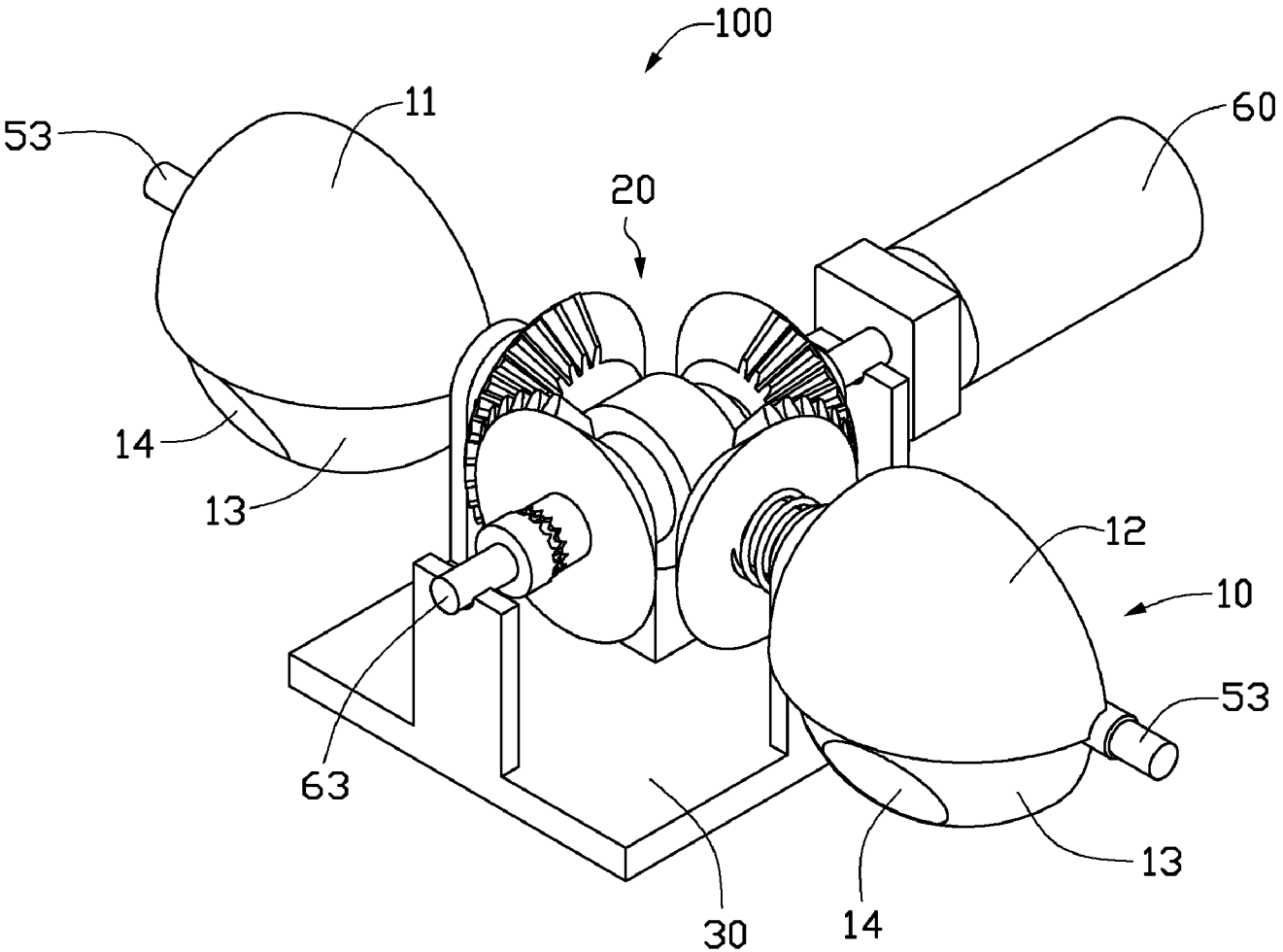
FIG. 1 is a perspective view of a simulated eye assembly having two eyelids in accordance with one embodiment.

Referring to FIG. 1, a simulated eye assembly 100 includes a simulated eye portion 10, a driving device assembly 20, and a bracket 30. The eye portion 10 engages with the driving device assembly 20 and is driven to change between an opened state and a closed state thereby. The eye portion 10 includes a first eyelid 11, a second eyelid 12, two semispherical eyeballs 13, and two irises 14 The two irises 14 are disposed on an external surface of the eyeballs 13 correspondingly. The eyelids 11, 12 partially cover the eyeballs 13 and are further coupled to the driving device assembly 20. The driving device assembly 20 is configured for driving the eyelids 11, 12 to rotate so as to shield and/or expose the irises 14. The bracket 30 is configured for supporting the driving device assembly 20. The simulated eye assembly 100 is fixed to a toy or a robot via the bracket 30.

Figure 2:
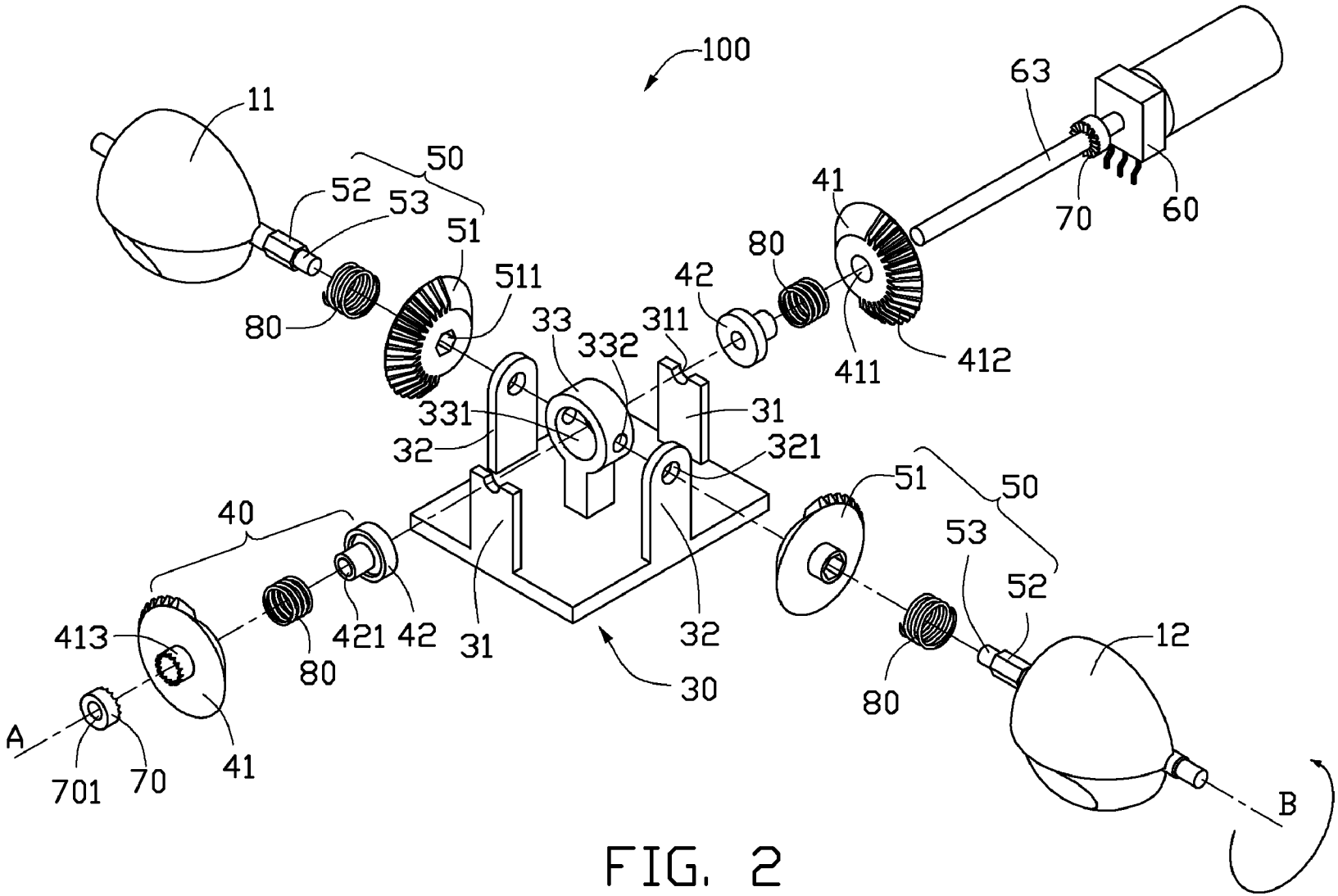
FIG. 2 is an exploded view of the simulated eye assembly of FIG. 1.

Referring to FIG. 2, the bracket 30 is substantially rectangular. Two first supporting members 31 protrude upwardly from a first pair of edges on opposite sides of the bracket 30 correspondingly. A semicircular recess 311 is defined in each first supporting member 31. Two second supporting member 32 protrude upwardly from a second pair of edges on opposite sides of the bracket 30 correspondingly. Each second supporting member 32 defines a round hole 321. A bearing member 33 is disposed at the middle of the bracket 30. A receiving space 331 is defined in the bearing member 33. Two second round holes 332 are defined in the bearing member 33 on opposite sides of the receiving space 331. The second round holes 332 communicate with the receiving space 331. The semicircular recesses 311 and a center of the receiving space 331 are aligned on line A. The round holes 321, 332 are aligned on line B. Line A and line B are coplanar and perpendicular.

The driving device assembly 20 includes two driving portions 40, two driven portions 50, a driving device 60, two transmission members 70, and a plurality of elastic elements 80. The driving device 60 is configured to rotate the driving portions 40 via the two transmission members 70. Each driven portion 50 engages with one of the two driving portions 40 and follows the rotation of the driving portions 40. The eyelids 11, 12 are fixed to the driven portions 50 correspondingly and are driven to rotate relative to the eyeballs 13. In the embodiment, each elastic element 80 is a spiral spring.

The driving device 60 has a rotor shaft 63. The rotor shaft 63 is rotated by the driving device 60. The two transmission members 70 are fixed to the rotor shaft 63 and rotate following the rotation of the rotor shaft 63. In the embodiment, the two transmission members 70 are gears. The driving device 60 is a servo-motor, or maybe a step motor. A first though hole 701 is defined in each transmission members 70.

Each driving portion 40 includes a first bevel gear 41, an elastic element 80, and an electromagnet 42. A second through hole 411 is defined in the first bevel gear 41. The first bevel gear 41 includes a first half toothed bevel gear 412, and a crown gear 413. The crown gear 413 meshes with one of the transmission members 70. The elastic element 80 is sandwiched between the electromagnet 42 and the first bevel gear 41. The first bevel gear 41 is made of magnetic material and is magnetized by the electromagnet 42. The electromagnet 42 is electrically connected to a circuit board (not shown). The circuit board is configured for selectively supplying the electromagnet 42 with power.

When the first bevel gears 41 do not mesh with the transmission members 70, the driving portions 40 are rotatable relative to the rotor shaft 63. When the first bevel gears 41 mesh with the transmission members 70, the driving portions 40 follow the rotation of the rotor shaft 63. When one of the first bevel gears 41 meshes with one of the transmission members 70, only one of the driving portions 40 follows the rotation of the rotor shaft 63, and the other one of the driving portions 40 is rotatable relative to the rotor shaft 63.

Each driven portion 50 includes a second half toothed bevel gear 51, an elastic element 80, a hollow polygonal post 52, and a pivot rod 53. A polygonal hole 511 is defined in second half toothed bevel gear 51 and is for receiving the hollow polygonal post 52. The hollow polygonal post 52 is fixed to the pivot rod 53 and following the rotation of the pivot rod 53. The pivot rod 53 is rotatable relative to the eyeballs 13.

In assembly, each driving portion 40 that meshes with one of the transmission members 70 is sandwiched between one of the first supporting members 31 and the bearing member 33. The electromagnets 42 are received in the receiving space 331 and are rotatable relative to the bearing member 33. Each crown gear 413 is arranged opposite to the electromagnets 42. The rotor shaft 63 extends through one of the semicircular recesses 311, one of the first through holes 701, one of the first driving portions 40, the receiving space 331, the other first driving portions 40, the other first through holes 701, and the other semicircular recesses 311 in turn. Each hollow polygonal post 52 engages with one of the polygonal hole 511. As the polygonal posts 52 are fixed to the pivot rods 53, thus, the second half toothed bevel gears 51 follow the rotation of the pivot rods 53. Each pivot rod 53 extends through one of the round holes 321, an elastic element 80, one of the hollow polygonal posts 52, and is received in one of the second round holes 332. The eyeballs 13 are rotatably coupled to the pivot rods 53. One of the eyelids 11, 12 is fixed to one of the pivot rod 53 and is coverable on one of the eyeballs 13.

After assembly, the teeth of the second half toothed bevel gear 51 mesh with the teeth of the first half toothed bevel gear 412. The teeth of each transmission member 70 mesh with that of the crown gear 413. As the transmission members 70 are fixed to the rotor shaft 63, accordingly, when the driving device 60 rotates the rotor shaft 63, each the second half toothed bevel gear 51 is driven to rotate around the line B by one of the corresponding first bevel gears 41. As the second half toothed bevel gears 51 follows the rotation of the pivot rods 53, and the eyelids 11, 12 are fixed to the two pivot rods 53, accordingly, the eyelids 11, 12 are driven to rotate around the line B by the second half toothed bevel gears 51. Therefore, the eyelids 11, 12 are driven to shield and expose the irises 14 via the driving device assembly 20.

When the electromagnets 42 are powered down, the first bevel gears 41 mesh with the transmission members 70. Accordingly, when the driving device 60 rotates the rotor shaft 63, the eyelids 11, 12 are driven to shield and exposed the irises 14 simultaneously.

Figure 3:
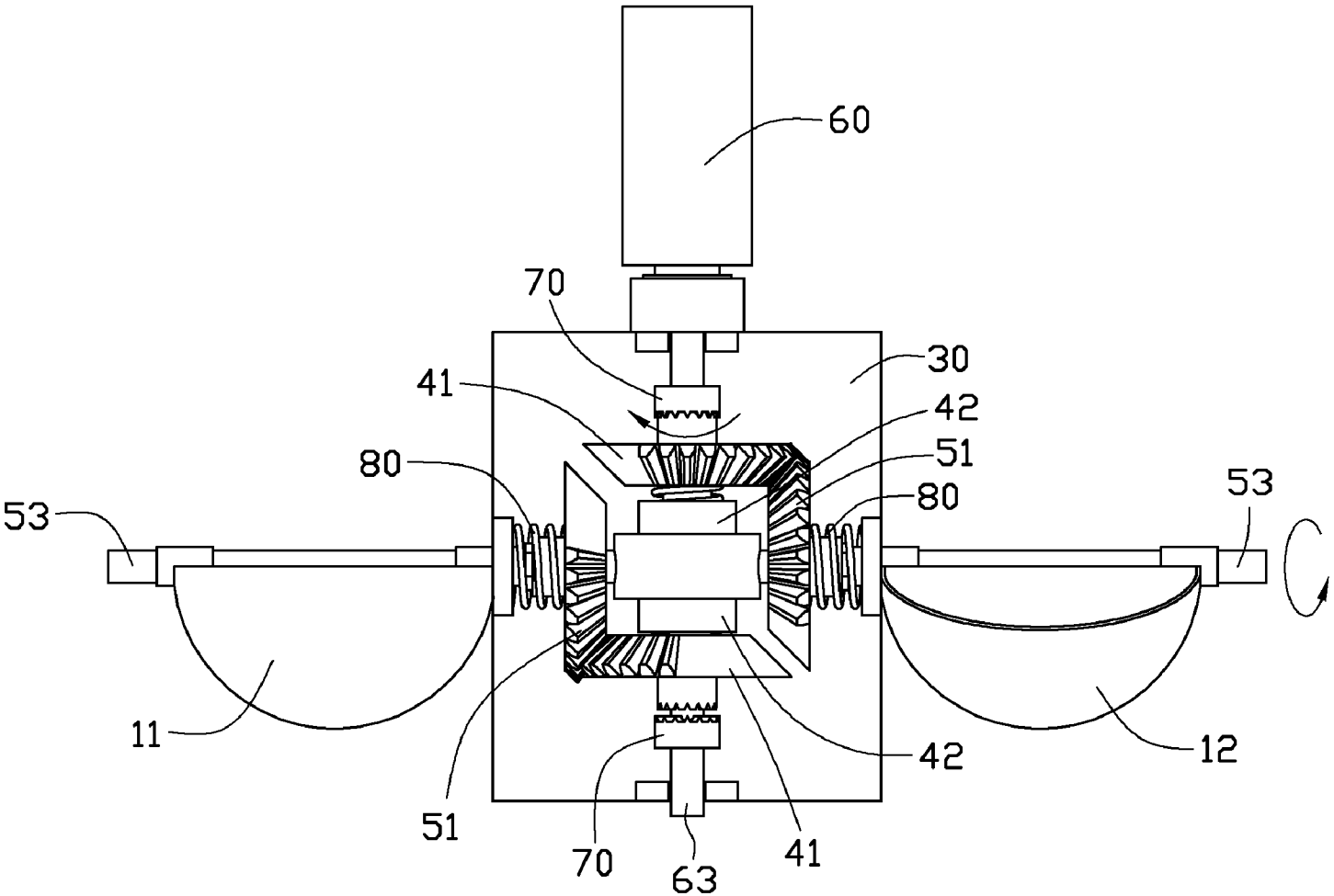
FIG. 3 is a perspective view of the simulated eye assembly of FIG. 1 while one of the two eyelids is closed.

Referring to FIG. 3, when the electromagnet 42 (hereinafter, the first electromagnet) furthest away from the driving device 60 is powered on and the other electromagnet (hereinafter, the second electromagnet) 42 is powered down, the first electromagnet 42 attracts the first bevel gear 41 adjacent thereto to move away the transmission member 70, as a result the elastic element 80 deforms elastically. Accordingly, when the driving device 60 rotates the rotor shaft 63, the first bevel gear 41 adjacent to the first electromagnet 42 does not rotate with the rotor shaft 63. As a result, the corresponding driven portion 50 does not rotate, and the first eyelid 11 does not rotate. When the first electromagnet 42 is powered down, the elastic element 80 releases elastic energy to drive the first bevel gear 41 to mesh with the transmission member 70, and the first eyelid 11 rotates following the second half toothed bevel gear 51.

Figure 4:
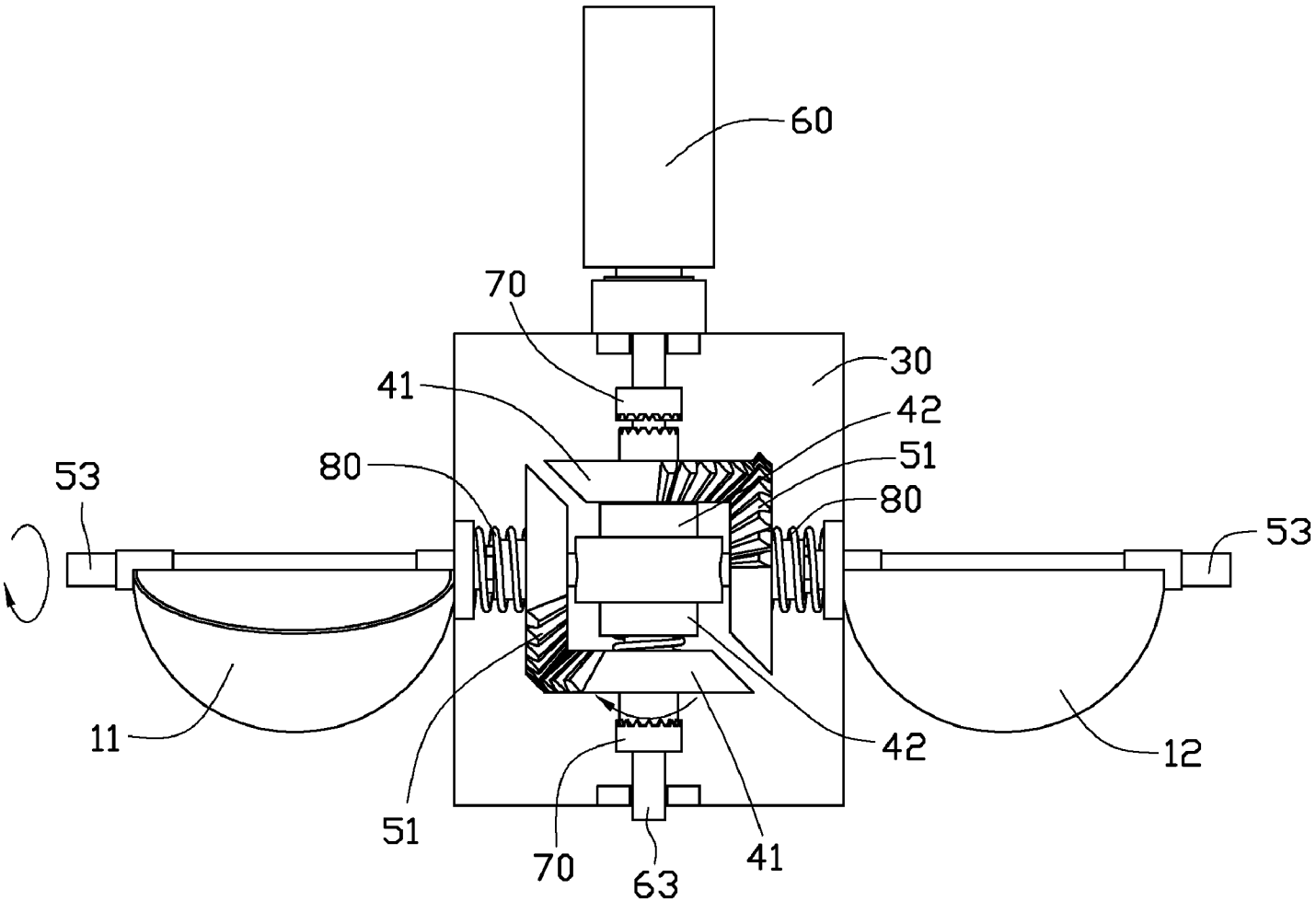
FIG. 4 is a perspective view of the simulated eye assembly of FIG. 1 while the other eyelid is closed.

Referring to FIG. 4, when the first electromagnet 42 is powered down, and the second electromagnet 42 is powered on, the second electromagnet 42 attracts the first bevel gear 41 adjacent thereto to move away the transmission member 70, and the elastic element 80 deforms elastically. Accordingly, when the driving device 60 rotates the rotor shaft 63, the first bevel gear 41 adjacent to the second electromagnet 42 does not rotate with the rotor shaft 63. As a result, the corresponding driven portion 50 does not rotate, and the second eyelid 12 does not rotate. When the second electromagnet 42 is powered down, the elastic element 80 releases elastic energy to drive the first bevel gear 41 to mesh with the transmission member 70, and the second eyelid 12 rotates again.

Therefore, by selectively supplying power to the electromagnets 42, the eyelids 11, 12 are selectively driven to shield and expose the irises 14 by the driving device 60, and the simulated eye assembly 100 is changeable between an opened state and a closed state.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye assembly, comprising:

an eye portion comprising at least one eyelid, and at least one eyeball; and a driving device assembly comprising at least one driving portion having an elastic element and an electromagnet, at least one driven portion, a driving device having a rotor shaft, and at least one transmission member, the electromagnet being rotatably coupled to the rotor shaft, the elastic element being arranged over the rotor shaft;

wherein the at least one driving portion is rotatably coupled to the rotor shaft and capable of meshing with the at least one transmission member, the at least one transmission member is fixed to the rotor shaft, the at least one driven portion meshes with the at least one driving portion, the at least one eyelid is fixed to the at least one driven portion and rotates therewith, the driving device is configured for rotating the at least one driving portion via the at least one transmission member, when the electromagnet is powered on, the elastic element is compressed, and the at least one driving portion does not mesh with the at least one transmission member, and when the electromagnet is powered down, the elastic element rebounds, and the at least one driving portion meshes with the at least one transmission member wherein the at least one driving portion comprises a first bevel gear, the first bevel gear comprises a first half toothed bevel gear portion, and a crown gear portion, the crown gear portion is fixed to the first half toothed bevel gear portion and meshes with one of the at least one transmission member; wherein the electromagnet is rotatably coupled to the rotor shaft and is arranged opposite to the crown gear portion of the first bevel gear.

2. The simulated eye assembly of claim 1, wherein the at least one first bevel gear comprises magnetic material and is attracted by the electromagnet while being powered on.

3. The simulated eye assembly of claim 2, wherein the elastic element is sandwiched between the electromagnet and the first bevel gear.

4. The simulated eye assembly of claim 1, wherein the at least one driven portion comprises a second half toothed bevel gear, a polygonal post, and a pivot rod, the teeth of the second half toothed bevel gear meshes with the teeth of the first half toothed bevel gear portion, a polygonal hole is defined in the second half toothed bevel gear and is for receiving the polygonal post, the polygonal post is fixed to the pivot rod.

5. The simulated eye assembly of claim 1, further comprising a bracket, the bracket supporting the driving device assembly, the at least one driving portion and the at least one driven portion being rotatable relative to the bracket.

6. The simulated eye assembly of claim 1, wherein the driving device is a step motor or a servo motor, the driving device drives the at least one eyelid to shield and expose the at least one eyeball.

7. A simulated eye assembly capable of being operated to change between an opened state and a closed state, the simulated eye assembly comprising:

an eye portion comprising at least one eyelid, and at least one eyeball, wherein an iris is disposed on the at least one eyeball, the at least one eyelid is coverable on the at least one eyeball; and a driving device assembly comprising at least one driving portion having an elastic element and an electromagnet, at least one driven portion, a driving device having a rotor shaft, and at least one transmission member, wherein the electromagnet is rotatably coupled to the rotor shaft, the elastic element is arranged over the rotor shaft, the at least one driving portion is rotatably coupled to the rotor shaft and capable of meshing with one of the at least one transmission member, the at least one transmission member is fixed to the rotor shaft, the at least one driven portion engages with the at least one driving portion and is rotatable relative to the eyeball, the at least one eyelid is fixed to the at least one driven portion and rotate therewith, the driving device is configured for rotating the at least one driving portion via the at least one transmission member, when the electromagnet is powered on, the elastic element is compressed, and the at least one driving portion does not mesh with the at least one transmission member, and when the electromagnet is powered down, the elastic element rebounds, and the at least one driving portion meshes with the at least one transmission member;

wherein when the eyelid is driven by the driving device to rotate relative to the eyeball to the closed state, the iris of the eyeball is substantially hidden by the eyelid, and when the eyelid is driven by the driving device to rotate relative to the eyeball to the opened state, the iris of the eyeball is exposed and viewable wherein the at least one driving portion comprises a first bevel gear, the first bevel gear comprises a bevel toothed portion, and a first half toothed bevel portion, and a crown gear portion, the crown gear portion is fixed to the first half toothed bevel gear portion and engages with the at least one transmission member, wherein the electromagnet is rotatably coupled to the rotor shaft and is arranged opposite to the crown gear portion of the first bevel gear.

8. The simulated eye assembly of claim 6, wherein the at least one first bevel gear comprises magnetic material and is attracted by the electromagnet while being powered on.

9. The simulated eye assembly of claim 8, wherein the elastic element is sandwiched between the electromagnet and the first bevel gear.

10. The simulated eye assembly of claim 7, wherein the at least one driven portion comprises a second half toothed bevel gear, a polygonal post, and a pivot rod, the teeth of the second half toothed bevel gear meshes with the teeth of the first half toothed bevel gear portion, a polygonal hole is defined in the second half toothed bevel gear and is for receiving the polygonal post, the polygonal post is fixed to the pivot rod.

11. The simulated eye assembly of claim 7, further comprising a bracket, the bracket supporting the driving device assembly, the at least one driving portion and the at least one driven portion are rotatable relative to the bracket.

12. The simulated eye assembly of claim 7, wherein the driving device is a step motor or a servo motor, the driving device drives the at least one eyelid to shield and expose the at least one iris.

* * * * *